US011088451B2

(12) United States Patent
Szczotka

(10) Patent No.: US 11,088,451 B2
(45) Date of Patent: Aug. 10, 2021

(54) ANTENNA SEGMENT AND MULTI-SEGMENT ANTENNA

(71) Applicant: TDK Electronics AG, München (DE)

(72) Inventor: Rafal Szczotka, Solothurn (CH)

(73) Assignee: TDK ELECTRONICS AG, Munich (DE)

( * ) Notice: Subject to any disclaimer, the term of this patent is extended or adjusted under 35 U.S.C. 154(b) by 189 days.

(21) Appl. No.: 16/467,843

(22) PCT Filed: Nov. 27, 2017

(86) PCT No.: PCT/EP2017/080516
§ 371 (c)(1),
(2) Date: Jun. 7, 2019

(87) PCT Pub. No.: WO2018/114234
PCT Pub. Date: Jun. 28, 2018

(65) Prior Publication Data

US 2019/0334240 A1 Oct. 31, 2019

(30) Foreign Application Priority Data

Dec. 21, 2016 (DE) ..... 102016125211.5

(51) Int. Cl.
*H01Q 7/06* (2006.01)
*H01Q 1/32* (2006.01)

(52) U.S. Cl.
CPC ..... *H01Q 7/06* (2013.01); *H01Q 1/3241* (2013.01)

(58) Field of Classification Search
CPC ..... H01Q 7/06; H01Q 7/08; H01Q 1/3241
See application file for complete search history.

(56) References Cited

U.S. PATENT DOCUMENTS

| | | | | |
|---|---|---|---|---|
| 7,135,978 | B2 * | 11/2006 | Gisselberg | A61B 5/062 340/572.5 |
| 10,056,687 | B2 | 8/2018 | Rojas Cuevas et al. | |
| 2014/0145904 | A1 | 5/2014 | Yoshikawa et al. | |
| 2015/0123761 | A1 | 5/2015 | Winkler | |
| 2017/0301995 | A1 * | 10/2017 | Tanaka | H01Q 1/2208 |
| 2020/0328513 | A1 * | 10/2020 | Pasko | H01F 3/10 |

FOREIGN PATENT DOCUMENTS

| | | | |
|---|---|---|---|
| EP | 2048738 | A1 | 4/2009 |
| EP | 3089176 | A1 | 11/2016 |
| JP | S60264105 | A | 12/1985 |
| JP | H09307327 | A | 11/1997 |
| JP | 2004229144 | A | 8/2004 |
| JP | 2011114853 | A | 6/2011 |
| JP | 2017195366 | A | 10/2017 |

* cited by examiner

*Primary Examiner* — Daniel Munoz
(74) *Attorney, Agent, or Firm* — Slater Matsil, LLP

(57) ABSTRACT

An antenna segment and a multi segment antenna are disclosed. In an embodiment an antenna segment includes a coil carrier comprising a first end section and a second end section, a wire coil arranged around the coil carrier and a magnetic core arranged in the coil carrier, wherein the magnetic core and the wire coil are arranged such that in the first end section the magnetic core and the coil carrier extend beyond the wire coil and in the second end section the coil carrier and the wire coil extend beyond the magnetic core.

11 Claims, 4 Drawing Sheets

ANTENNA SEGMENT AND MULTI-SEGMENT ANTENNA

This patent application is a national phase filing under section 371 of PCT/EP2017/080516, filed Nov. 27, 2017, which claims the priority of German patent application 102016125211.5, filed Dec. 21, 2016, each of which is incorporated herein by reference in its entirety.

TECHNICAL FIELD

The invention relates to an antenna segment for an antenna with a magnetic core and a multi-segment antenna. Additionally the invention relates to methods for producing an antenna segment and a multi-segment antenna.

BACKGROUND

In current technology, especially in the automotive engineering sector, there is an increasing demand for inductive assembly components and, especially, ferrite antennas, wherein the ferrite antennas, due to installation reasons, should be as long and narrow as possible. Such ferrite antennas are used especially in connection with key-less actuation and/or closure devices for vehicles, the ferrite antennas being disposed in door grips, in an interior, or in a bumper.

With respect to such ferrite antennas, however, it is difficult to configure such antennas with greater than a predetermined length or with less than a predetermined thickness. These limitations arise from the fact that the production of very small ferrite cores of large length is time-consuming and difficult and that the thickness of the coil carrier must be taken into account when considering the total thickness of the building components.

SUMMARY OF THE INVENTION

Embodiments provide an antenna segment and a multi-segment antenna as well as methods for producing the antenna segment and the multi-segment antenna, allowing for a cost-effective provision of antenna segments and multi-segment antennas with sufficient or good antenna efficiency.

Embodiments provide an antenna segment comprising a coil carrier with a first end section and a second end section. Furthermore the antenna segment comprises a wire coil which is arranged around the coil carrier and a magnetic core arranged in the coil carrier, wherein the magnetic core and the wire coil are arranged such that in the first end section the magnetic core and the coil carrier extend beyond the wire coil and in the second end section the coil carrier and the wire coil extend beyond the magnetic core.

By using such antenna segments, manufacturing and labor costs can be reduced in comparison with the manufacturing of long antennas, in particular long low frequency antennas. Using a highly sophisticated manufacturing process and equipment, e.g. winding machines with synchronized driver and support, is not necessary. In the case of a monolith ferrite core, where the coil is wound directly on the core, due to a size proportion and its natural fragility the ferrite core is easily breakable as a result of handling and/or coil winding tension. Additionally, winding directly on the ferrite core demands usage of highly sophisticated winding machines to avoid torsion of the ferrite core. For multi-core segments and single-coil solutions the core insertion, in particular the ferrite core insertion, to the coil is a highly labor-intensive process affected by the risk of coil damage. Additionally, the long slide of ferrite core segments demands sophisticated production fixtures or jigs.

Furthermore, the antenna segments can reliably be connected together to form a long antenna. Thus, the connected antenna elements serve as a long antenna and not as separate antennas. Thus, sufficient or good antenna efficiency can be reached.

In one embodiment according to the first aspect, the first end section comprises a first shape and the second end section comprises a second shape complementary to the first shape. Advantageously, the shapes of the first and second end sections allow for optimal coupling of the coil carrier and wire coil segments, as well as for easy manufacturing.

In a further embodiment according to the first aspect, the magnetic core comprises a ferrite material or consists of a ferrite material. Because of the reduced core torsion, it is possible to use ferrite materials, which provide better electromagnetic performance of the antenna segment than e.g. core materials like a magnetostriction-free amorphous cobalt based alloy (VITROVAC®).

In a further embodiment according to the first aspect, the antenna segment comprises at least two joint interface elements, wherein the at least two joint interfaces serve as a starting point and an end point of the wire coil, respectively. The at least two joint interface elements are arranged and configured to provide electrical coupling of the wire coils of adjacent antenna segments in a coupling state of at least two antenna segments.

Embodiments provide a multi-segment antenna comprising at least two antenna segments according to the first aspect, wherein the at least two antenna segments are arranged in a row such that the first end section of a respective subsequent antenna segment and the second end section of a respective previous antenna segment of joining antenna segments mechanically interlock.

Advantageous embodiments of the first aspect are also valid for the second aspect. The multi-segment antenna might be configured as a low frequency antenna, for example, for applications in a frequency range of 22 kHz.

In one embodiment according to the second aspect, an adhesive substance is arranged between respective joining magnetic cores of the antenna segments. Advantageously, in this way gaps between the magnetic cores can be avoided or smallest possible gaps between the magnetic cores can be ensured.

In a further embodiment according to the second aspect, a last antenna-segment arranged on an end of the row of antenna segments comprises a plug arranged in the second end section of the last antenna-segment. In this way the magnetic cores can be pressed tight to each other.

Embodiments provide a method for producing an antenna segment. For producing the antenna segment, a magnetic core with a first length and a coil carrier with a second length are provided, wherein the second length is greater than the first length. Furthermore, the magnetic core is inserted into the coil carrier such that on the second end section of the coil carrier the coil carrier extends beyond the magnetic core and the wire coil is wound on the coil carrier such that the wire coil is arranged in the second end section and between the first end section and the second end section of the coil carrier. In this regard, advantageous embodiments of the first aspect are also valid for the third aspect.

Embodiments provide a method for producing a multi-segment antenna. For producing the multi-segment antenna, at least two antenna segments according to the first aspect are provided and the at least two antenna segments are coupled such that the at least two antenna segments are arranged in a row and the first end section of a respective subsequent antenna segment and the second end section of a respective previous antenna segment of joining antenna segments mechanically interlock. Advantageous embodiments of the first to third aspects are also valid for the fourth aspect.

BRIEF DESCRIPTION OF THE DRAWINGS

Exemplary embodiments of the invention are explained in the following with the aid of schematic drawings. These are as follows.

Similar elements, elements of the same kind and identically acting elements may be provided with the same reference numerals in the figures.

DETAILED DESCRIPTION OF ILLUSTRATIVE EMBODIMENTS

Figure 1:
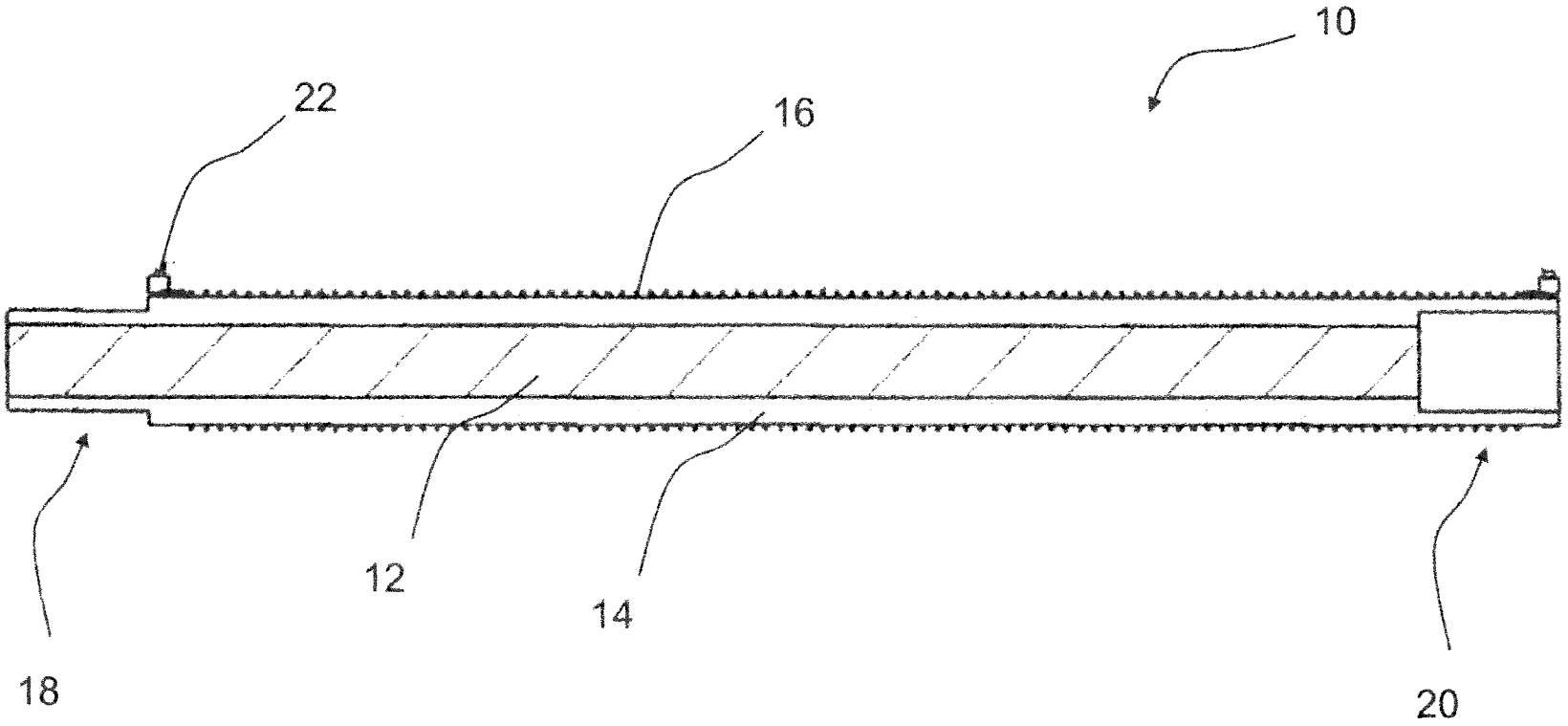
FIG. 1 shows an exemplary embodiment of an antenna segment in a longitudinal section view.

FIG. 1 shows an exemplary embodiment of an antenna segment 10 in a longitudinal section view.

The antenna segment 10 comprises a coil carrier 14 with a first end section 18 and a second end section 20. Furthermore the antenna segment 10 comprises a wire coil 16 which is arranged around the coil carrier 14 and a magnetic core 12 arranged in the coil carrier 14. The magnetic core 12 and the wire coil 16 are arranged such that in the first end section 18 of the coil carrier 14 the magnetic core 12 and the coil carrier 14 extend beyond the wire coil 16 and in the second end section 20 of the coil carrier 14 the coil carrier 14 and the wire coil 16 extend beyond the magnetic core 12.

Thus, the wire coil 16 is shifted and arranged asymmetrically with respect to the magnetic core 12. The coil carrier 14 is carrying the wire coil 16 even beyond the core's end, so that the wire coil 16 extends beyond the core's end.

Thus, the first end section 18 is not covered by the wire coil 16. In the first end section 18, preferably, the coil carrier 14 ends flush with the magnetic core 12.

The magnetic core 12 may comprise a plurality of core segments. The magnetic core 12 may have a circular, elliptical or rectangular cross section.

In particular, the first end section 18 forms a first coupling section and the second end section 20 forms a second coupling section allowing in a coupling state of joining antenna segments 10, 10' a mechanical interlocking of the first end section 18 and the second end section 20 of the adjacent antenna segments 10, 10'.

This means that each antenna segment's tail, i.e., the side where the wire coil 16 extends beyond the magnetic core 12, and each antenna segment's head, i.e., the side where the magnetic core 12 is not covered by the wire coil 16, functions as a respective coupling section. In particular, the antenna segment's head comprises a protrusion and the antenna segment's tail comprises a slot, wherein the protrusion of the head of a subsequent antenna segment 10' can be inserted into the slot of the tail of a previous antenna segment 10.

Preferably, a first length of the first end section 18 is equal to a second length of the second end section 20.

Preferably, the magnetic core 12 comprises a ferrite material or consists of a ferrite material. The coil carrier 14, for instance, comprises a plastic material or consists of a plastic material.

For producing the antenna segment 10, the magnetic core 12 with a first length and the coil carrier 14 with a second length are provided, wherein the second length is greater than the first length. Furthermore the magnetic core 12 is inserted into the coil carrier 14 such that on the second end section 20 of the coil carrier 14 the coil carrier 14 extends beyond the magnetic core 12. The wire coil 16 is wound on the coil carrier 14 such that the wire coil 16 is arranged in the second end section 20 and between the first end section 18 and the second end section 20 of the coil carrier 14.

Figure 2:
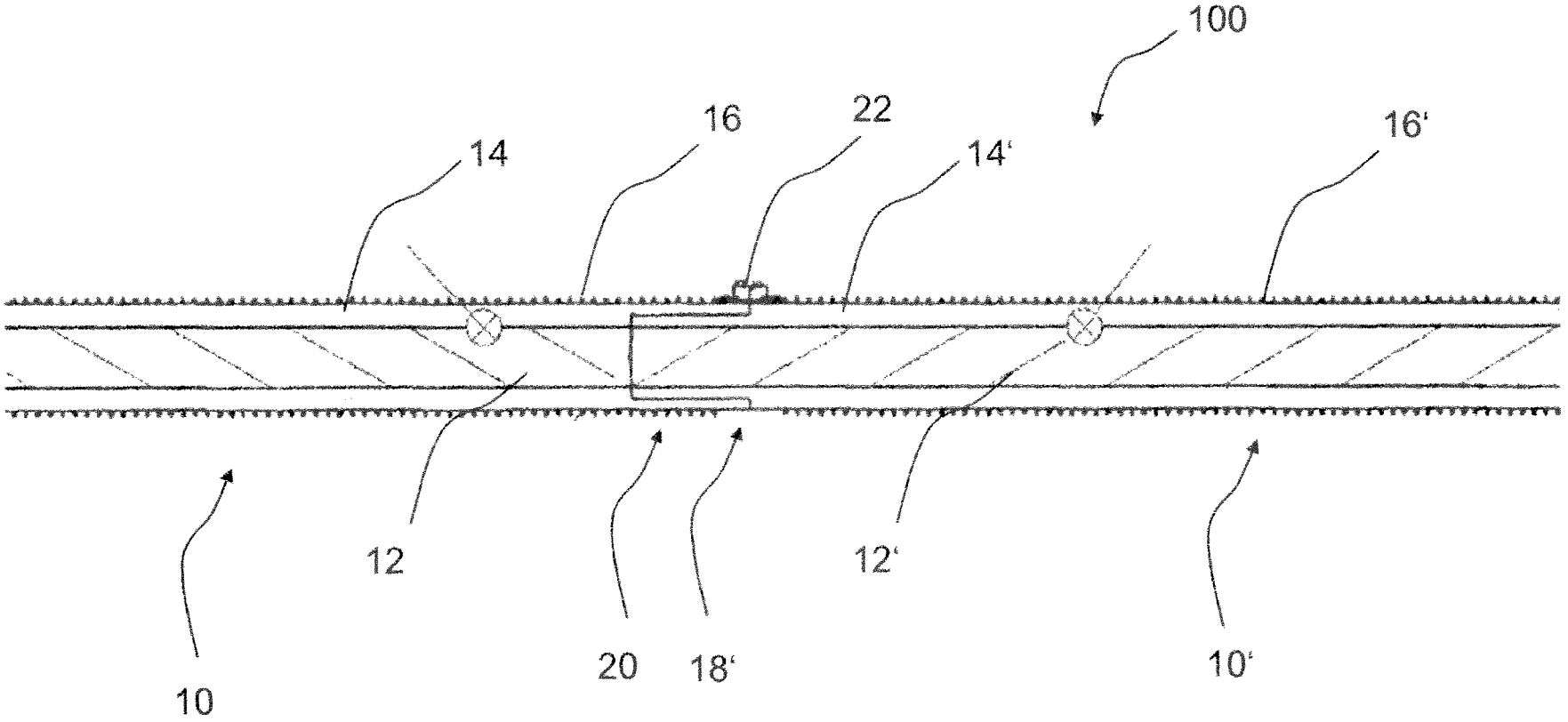
FIG. 2 shows an exemplary embodiment of a multi-segment antenna in a longitudinal section view.

FIG. 2 shows an exemplary embodiment of a multi-segment antenna 100 in a longitudinal section view.

The multi-segment antenna 100 comprises at least two antenna segments 10, 10'. The at least two antenna segments 10, 10' are arranged in a row such that the first end section 18 of a respective subsequent antenna segment 10' and the second end section 20 of a respective previous antenna segment 10 of joining antenna segments 10, 10' mechanically interlock.

Thus, the magnetic cores 12, 12' of joining antenna segments 10, 10' are arranged face-to-face with each other. Optionally an adhesive substance is arranged between respective joining magnetic cores 12, 12' of the antenna segments 10, 10'.

The first end section 18 of the previous antenna segment 10 is covered by the wire coil 16 of the second end section 20 of the subsequent antenna segment 10'.

For instance, each antenna segment 10, 10' comprises at least two joint interface elements 22. The at least two joint interface elements 22 serve as a starting point and an end point of the wire coil 16, respectively. The at least two joint interface elements 22 are arranged and configured to provide electrical coupling of the wire coils 16, 16' of the adjacent antenna segments 10, 10' of the multi-segment antenna 100.

Preferably, the respective joint interface elements 22 of the adjacent antenna segments 10, 10' are cohesively coupled, for instance by soldering and/or welding and/or crimping. In this way, a stable electrical coupling can be provided.

For producing the multi-segment antenna 100, at least two antenna segments 10, 10' are coupled such that the at least two antenna segments 10, 10' are arranged in a row and the first end section 18 of a respective subsequent antenna segment 10' and the second end section 20 of a respective previous antenna segment 10 of joining antenna segments 10, 10' mechanically interlock.

In particular, the protrusion of the head of a subsequent antenna segment 10' is inserted into the slot of the tail of a previous antenna segment 10.

Figure 3:
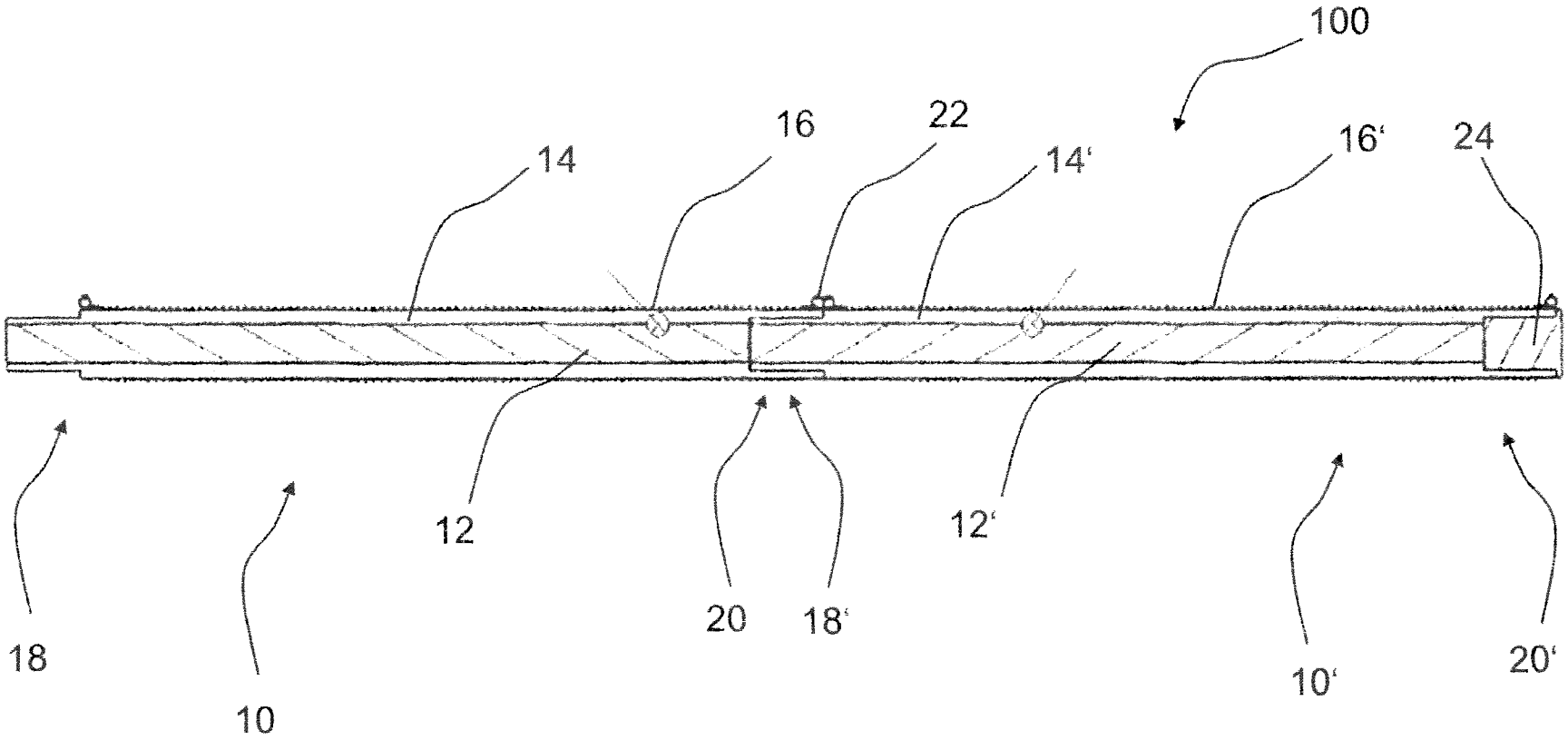
FIG. 3 shows a further exemplary embodiment of the multi-segment antenna in a longitudinal section view.

FIG. 3 shows a further exemplary embodiment of the multi-segment antenna 100 in a longitudinal section view.

In comparison to the embodiment of the multi-segment antenna 100 as shown in FIG. 2, in this multi-segment antenna 100 a last antenna segment arranged on an end of the row of antenna segments comprises a plug 24 arranged in the second end section 20 of the last antenna segment.

Figure 4:
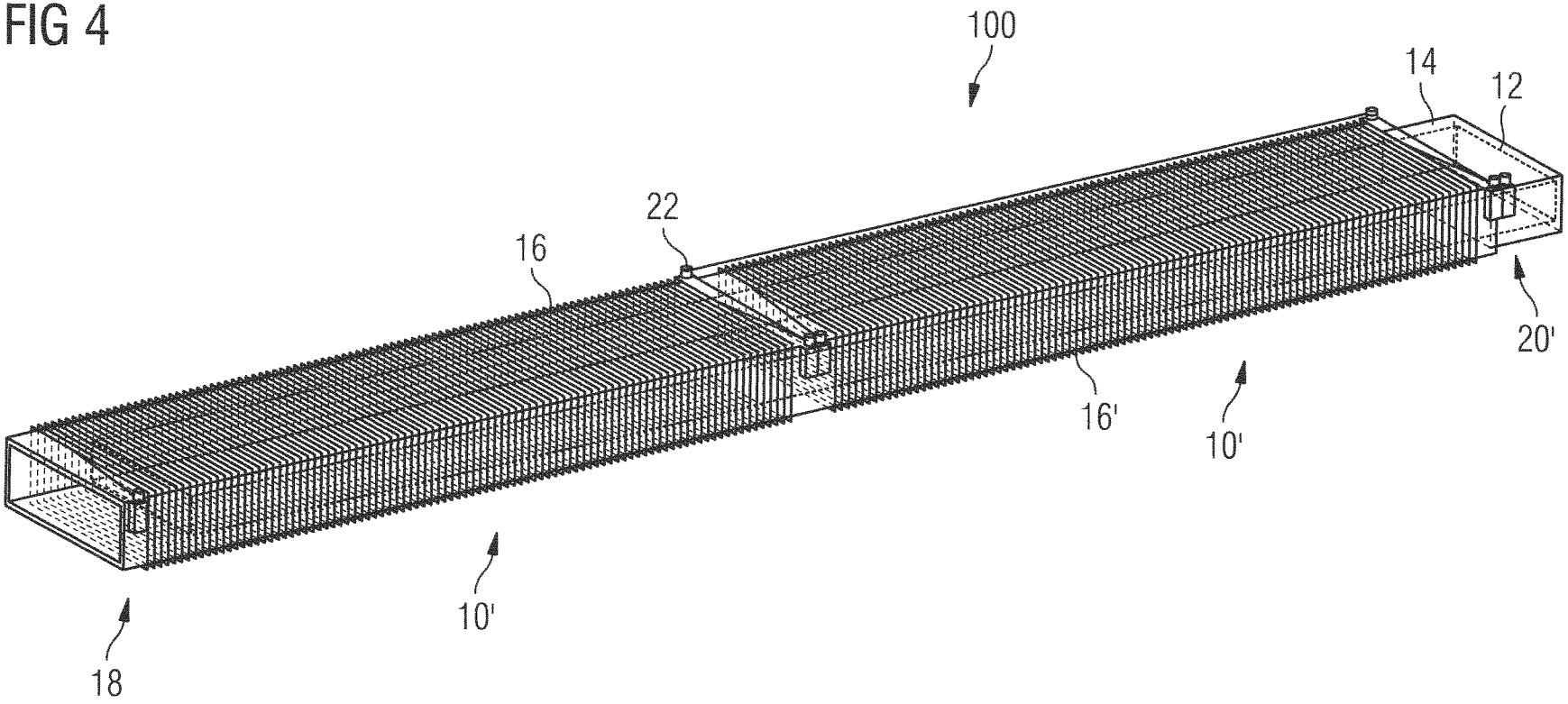
FIG. 4 shows an exemplary embodiment of a multi-segment antenna in perspective view.

FIG. 4 shows an exemplary embodiment of a multi-segment antenna 100 in perspective view.

The invention claimed is:

1. A multi-segment antenna comprising:

at least two antenna segments, wherein the at least two antenna segments are arranged in a row of antenna segments, wherein a first end section of a respective subsequent antenna segment has a first shape and a second end section of a respective previous antenna segment of joining antenna segments has a second shape complementary to the first shape such that the first and second end sections mechanically interlock, wherein each antenna segment comprises:

a coil carrier comprising a first end section and a second end section;

a wire coil arranged around the coil carrier; and a magnetic core arranged in the coil carrier, and wherein the magnetic core and the wire coil are arranged such that in the first end section the magnetic core and the coil carrier extend beyond the wire coil and in the second end section the coil carrier and the wire coil extend beyond the magnetic core.

2. The multi-segment antenna according to claim 1, wherein an adhesive substance is arranged between respective joining magnetic cores of the antenna segments.

3. The multi-segment antenna according to claim 1, wherein a last antenna segment arranged on an end of the row of antenna segments comprises a plug arranged in the second end section of the last antenna segment.

4. The multi-segment antenna according to claim 1, wherein the magnetic core of the at least two antenna segments comprises a ferrite material.

5. The multi-segment antenna according to claim 1, wherein each antenna segment comprises at least two joint interface elements, wherein the at least two joint interface elements serve as a starting point and an end point of the wire coil, respectively, and are configured to provide electrical coupling of the wire coils of adjacent antenna segments in a coupling state of the at least two antenna segments.

6. The multi-segment antenna according to claim 1, wherein each antenna segment comprises exactly two joint interface elements, wherein the two joint interface elements serve as a starting point and an end point of the wire coil, respectively, and are configured to provide electrical coupling of the wire coils of adjacent antenna segments in a coupling state of the at least two antenna segments.

7. The multi-segment antenna according to claim 6, wherein a last antenna segment arranged on an end of the row of antenna segments comprises a plug arranged in the second end section of the last antenna segment.

8. A method for producing a multi-segment antenna, wherein the multi-segment antenna comprises at least two antenna segments, the method comprising:

providing a magnetic core with a first length;

providing a coil carrier with a second length, wherein the second length is greater than the first length and the coil carrier comprises a first end section and a second end section;

inserting the magnetic core into the coil carrier and winding a wire coil on the coil carrier such that in the first end section the magnetic core and the coil carrier extend beyond the wire coil and in the second end section the coil carrier and the wire coil extend beyond the magnetic core; and coupling the at least two antenna segments such that the at least two antenna segments are arranged in a row and the first end section of a respective subsequent antenna segment having a first shape, and the second end section of a respective previous antenna segment of joining antenna segments having a second shape complementary to the first shape, mechanically interlock.

9. The method according to claim 8, wherein the magnetic core comprises a ferrite material.

10. A method comprising:

providing a magnetic core with a first length;

providing a coil carrier with a second length, wherein the second length is greater than the first length and the coil carrier comprises a first end section and a second end section;

inserting the magnetic core into the coil carrier and winding a wire coil on the coil carrier thereby producing an antenna segment, wherein, in the first end section, the magnetic core and the coil carrier extend beyond the wire coil and, in the second end section, the coil carrier and the wire coil extend beyond the magnetic core, wherein the first end section has a first shape and the second end section has a second shape complementary to the first shape; and coupling at least two antenna segments such that the at least two antenna segments are arranged in a row forming a multiple-segment antenna, wherein coupling comprises coupling the at least two antenna segments such that the first end section of a respective subsequent antenna segment and the second end section of a respective previous antenna segment mechanically interlock.

11. The method according to claim 10, wherein the magnetic core comprises a ferrite material.

* * * * *